US009360258B2

(12) United States Patent
Bronicki et al.

(10) Patent No.: US 9,360,258 B2
(45) Date of Patent: Jun. 7, 2016

(54) FIN CONFIGURATION FOR AIR COOLED HEAT EXCHANGER TUBES

(71) Applicants: Lucien Y. Bronicki, Yavne (IL); Uriyel Fisher, Haifa (IL)

(72) Inventors: Lucien Y. Bronicki, Yavne (IL); Uriyel Fisher, Haifa (IL)

(73) Assignee: Ormat Technologies, Inc., Reno, NV (US)

( * ) Notice: Subject to any disclaimer, the term of this patent is extended or adjusted under 35 U.S.C. 154(b) by 467 days.

(21) Appl. No.: 13/837,077

(22) Filed: Mar. 15, 2013

(65) Prior Publication Data

US 2014/0262156 A1 Sep. 18, 2014

(51) Int. Cl.

| | |
|---|---|
| ***F28F 1/30*** | (2006.01) |
| ***F28F 21/08*** | (2006.01) |
| *F28F 1/24* | (2006.01) |

(52) U.S. Cl.

CPC ..... *F28F 1/30* (2013.01); *F28F 21/084* (2013.01)

(58) Field of Classification Search

CPC ..... F28F 1/30; F28F 1/32; F28F 1/20; F28F 1/24; F28F 1/10; F28F 1/12; F28F 21/084

See application file for complete search history.

(56) References Cited

U.S. PATENT DOCUMENTS

| | | | | |
|---|---|---|---|---|
| 1,818,727 | A * | 8/1931 | Ludwig | 165/151 |
| 2,217,469 | A * | 10/1940 | Clarke | 165/181 |
| 2,458,189 | A * | 1/1949 | Morgan | 29/890.046 |
| 2,627,652 | A * | 2/1953 | Schweller | 72/359 |
| 3,077,928 | A * | 2/1963 | Nihlen et al. | 165/180 |
| 3,724,537 | A * | 4/1973 | Johnson | 165/133 |
| 4,337,824 | A * | 7/1982 | Kirk | 165/70 |
| 2008/0023180 | A1 | 1/2008 | Bunker et al. | |
| 2010/0155041 | A1 | 6/2010 | Robidou et al. | |

* cited by examiner

*Primary Examiner* — Tho V Duong

(74) *Attorney, Agent, or Firm* — Oblon, McClelland, Maier & Neustadt, L.L.P.

(57) ABSTRACT

An air cooled, finned heat exchanger tube includes a metallic tube through which fluid to be cooled is flowable. The tube has an outer surface on which axially spaced axial indentations are formed over its circumference, and a plurality of axially spaced fins each of which has a main element formed with heat transfer promoting patterns and a base angled with respect to said main element. The base is frictionally and irremovably secured within a corresponding indentation so that said tube outer surface is completely covered.

4 Claims, 6 Drawing Sheets

SIMPLE OR KNURLED L FIN

SIMPLE OR KNURLED L FIN

DOUBLE WRAPPED L FIN TYPE

SHOWING PATTERNS ON RIBBON 1.8
20
17.875
15.875
3
5
5
2.42 MM
2
2
2
BASIC RIBBON = 20 MM 4
8C
8B
8A
3
9

FIN CONFIGURATION FOR AIR COOLED HEAT EXCHANGER TUBES

FIELD

The present invention relates to the field of heat exchangers. More particularly, the invention relates to a fin configuration for air cooled heat exchanger tubes.

BACKGROUND

In air cooled heat exchangers, and particularly condensers, heat is transferred from the hot fluid that flows inside the tubes to the ambient air by passive or forced air flow on the external side of the heat exchanger tubes. The heat transfer between a naked tube and the air is very poor. To improve the efficiency of heat transfer, the heat transfer area of the tubes has been increased by adding fins to each tube. However, incompatible heat flow patterns from the fin to the air and from the tube to the fin showed that contact between a fin and tube not always led to efficient heat transfer of the heat in the fluid to the air.

Finned tubes of air cooled condensers are designed either with plate fins that slide onto the tube and are placed at a desired distance from one another on the tube or by continuously wrapped spiral fins.

A major problem in finned tubes that are not made of a single piece is the heat transfer between the tube and the fin.

With respect to one prior art fin design whereby the inner diameter of the plate fins is substantially equal to the outer diameter of the tube, the fins are brazed, galvanized, soldered or welded to the tube. Alternatively, the tube is made of relatively soft material which is inflated by a pressure pump. The tube diameter is thereby increased to facilitate fastening of the fin onto the tube. This fin design is used only on relatively small sized heat exchangers because of the cost.

In spiral wrapped fins that are usually made of a continuous aluminum ribbon, the fin is either embedded by force into a slot that is preformed on the tube or is wrapped into different types of L-shapes, such as wrap-on, knurled or double L.

US 2008/0023180 and US 2010/0155041 disclose finned tubes that are relief structured and that are manufactured by pressing the fin material into grooves formed in the external wall of the tube. The fins, which are substantially parallel to each other, have an annular shape and are substantially perpendicular to the tube.

Even though this fin configuration provides a significant increase in the heat transfer coefficient between the fin and air as a result of the relief structure formed on the fin, the point of contact between a fin and tube is small, constituting a limited and unreliable means of heat transmission between the fin and tube. An additional drawback of such a fin design is that the circumference of the tube surface between adjacent fins is bare, and therefore the metallic tube surface is subject to corrosion when exposed to e.g. precipitation, thereby lowering the heat transfer coefficient due to the build up of corrosion or requiring to be made of expensive corrosion resisting materials.

It is an object of the present invention to provide heat exchanger tubes having a higher tube-fin heat transfer coefficient than those of the prior art.

It is an additional object of the present invention to provide heat exchanger tubes to which fins are connectable by a large area connection that is not labor intensive.

It is an additional object of the present invention to provide a heat exchanger that can made from inexpensive tubes, without risk that they will corrode.

Other objects and advantages of the invention will become apparent as the description proceeds.

SUMMARY

The present invention provides an air cooled, finned heat exchanger tube, comprising a metallic tube through which fluid to be cooled is flowable, having an outer surface on which axially extending indentations are formed over its circumference, and a plurality of axially spaced fins each of which having a main element formed with heat transfer promoting patterns and a base angled with respect to said main element, wherein said base is frictionally and irremovably secured within said indentations such that said tube outer surface is completely covered by the base of said fins.

DETAILED DESCRIPTION

The present invention is directed to an air cooled heat exchanger wherein its thin-walled tubes have fins that are fixed thereto advantageously by an automated large area connection. The fins may be provided with heat transfer promoters for causing enhanced air flow near the fin surface. The heat exchanger can often be used as e.g. a condenser for cooling turbine discharge, for example organic motive fluid circulating in an Organic Rankine Cycle circuit, although other types of air cooled heat exchangers are also within the scope of the invention. Such condensers can be used in geothermal power plants and other power plants such as waste heat power plants or other power units.

Figure 1:
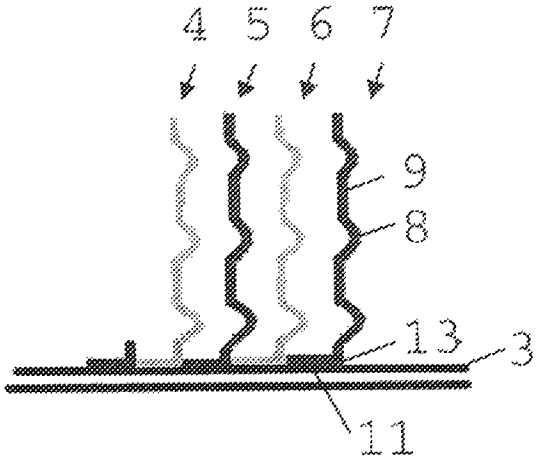
FIG. 1 is a cross-section view of a fin portion, according to one embodiment of the present invention.

FIG. 1 illustrates a cross-section view of a fin portion, according to one embodiment of the present invention. A plurality of axially spaced fins, e.g. fins 4-7, are attached to heat exchanger tube 3 through which a fluid to be cooled flows so that the fins are substantially perpendicular to the axis of tube 3. Each of these fins is formed, and advantageously preformed, with a plurality of depressions 8, which are depressed with respect to an adjacent planar fin portion 9 to provide an undulated appearance, in order to induce enhanced air flow within the air flowing across the fins and to thereby increase heat dissipation from the fluid flowing in heat exchanger tube 3.

Figures 2A, 2B, 2C:
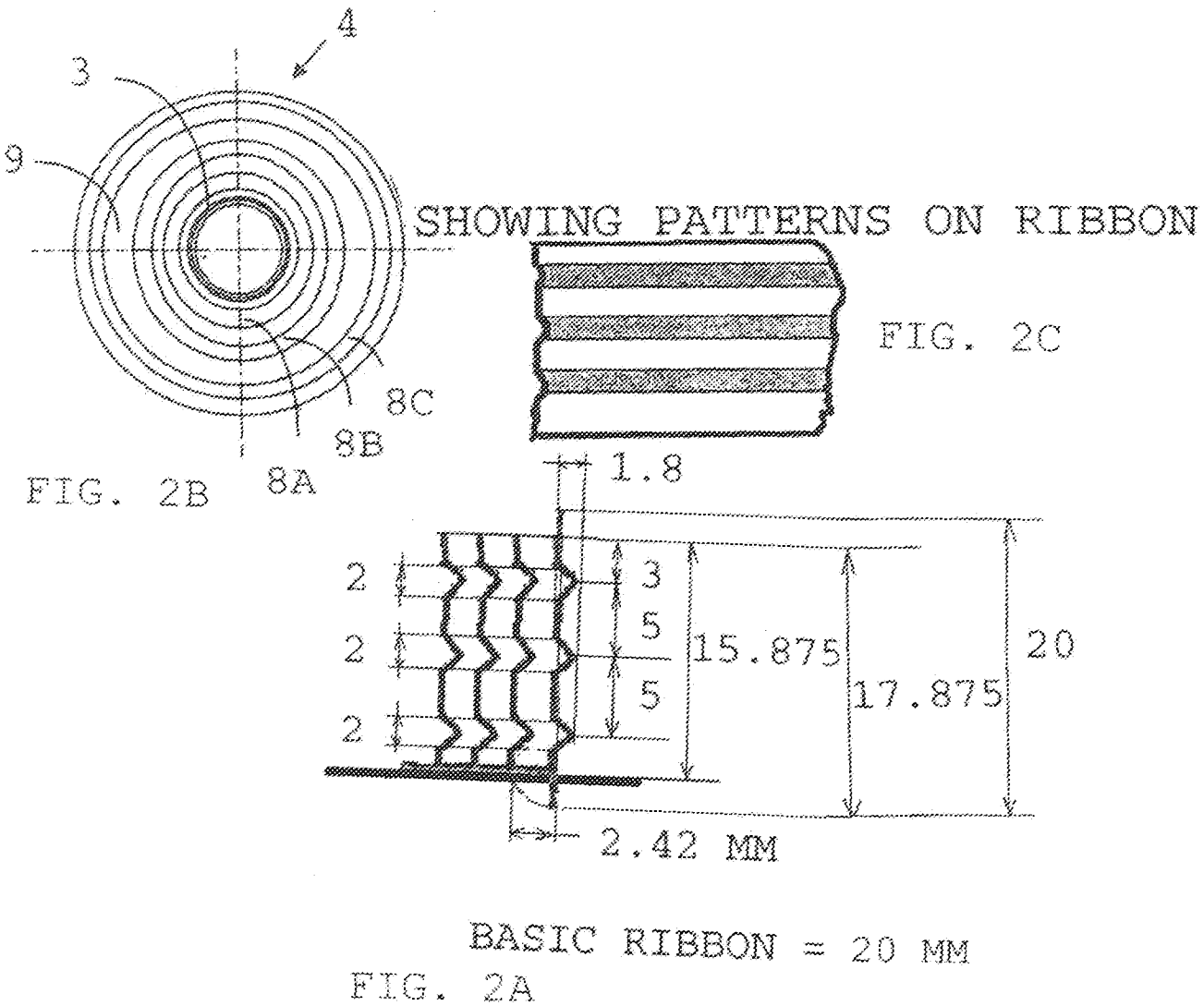
FIGS. 2A, 2B and 2C are respectively cross-sectional, front and plan views of a finned heat exchanger tube that includes the fin portion of FIG. 1.

As shown in FIG. 2, fin 4 may be made of an annular plate, e.g. made of aluminum and having a thickness ranging from 0.4-1.2 mm, surrounding, and connected to, tube 3. The plurality of depressions 8*a-c* circumferentially extend throughout the plate and are advantageously concentric, while the radial spacing between adjacent depressions corresponding to the position of a planar portion 9 may differ.

Referring back to FIG. 1, each fin is also formed with a base 11 that is angled with respect to proximal end 13 thereof, i.e. the most radially inwardly disposed planar fin portion, for contacting, and being connected to, the tube surface by a large area connection. Base 11 is shown to be angled with respect to proximal end 13 by advantageously a right angle, but it will be appreciated that proximal end 13 can be oriented at any other desired angle with respect to base 11.

Base 11 may extend in an opposite direction as the direction to which each undulation 8 is depressed. Advantageously, the length of base 11 is greater than the depression depth of each undulation 8, and may be sufficiently long to contact the proximal end 13 of the adjacent fin and to cover the entire circumference of the tube surface, thereby preventing the build up of corrosion. Alternatively, the proximal end 13 of one fin may overlap the base 11 of an adjacent fin.

For example three depressions having a depth of 1.8 mm and a radial dimension of 2.0 mm are formed in an aluminum ribbon having a width of 20.0 mm, reducing the radial dimension of the fin to 15.875 mm. The base contacting the proximal end of the adjacent fin has an axial dimension of 2.42 mm.

Figure 3:
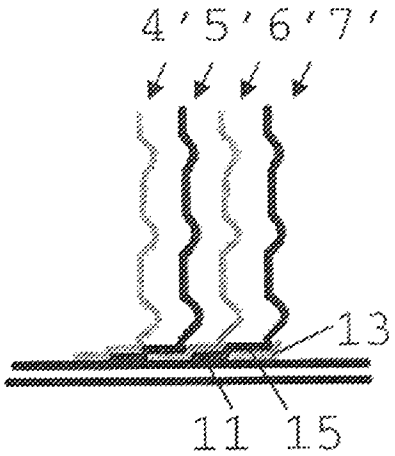
FIG. 3 is a cross-section view of a fin portion, according to another embodiment of the invention.

In FIG. 3, fins 4'-7' are provided with a stepped connection whereby base 11 is connected to tube 3 by a large area connection and an additional surface 15 substantially parallel to base 11 extends to the fin proximal end 13. Such structure provides an enhanced cover to the entire circumference of the tube surface, thereby providing additional means for preventing the build up of corrosion.

Figure 4:
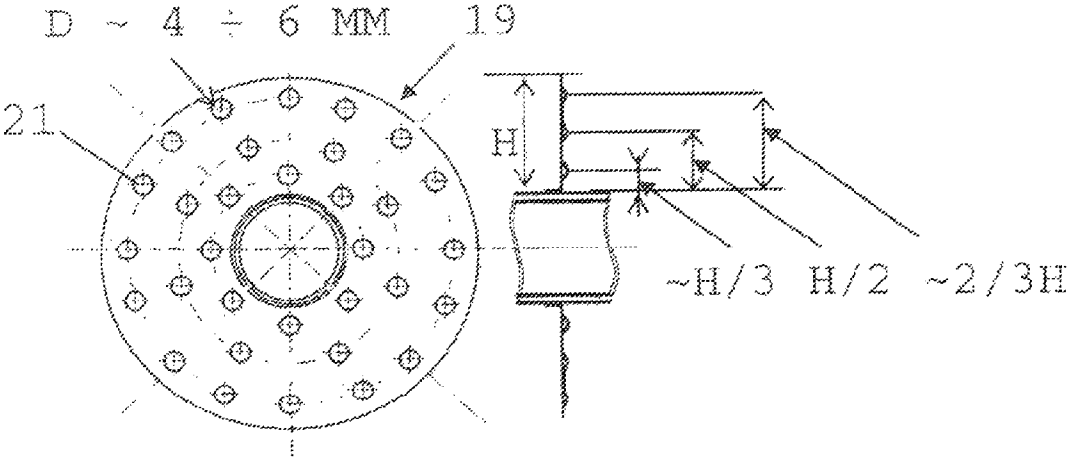
FIGS. 4-6 are a front view of a finned heat exchanger tube according to three embodiments of the invention, respectively.
Figure 5:
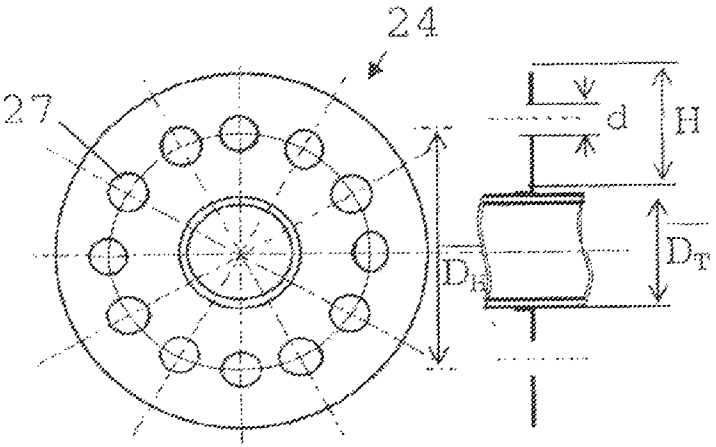
Figure 6:
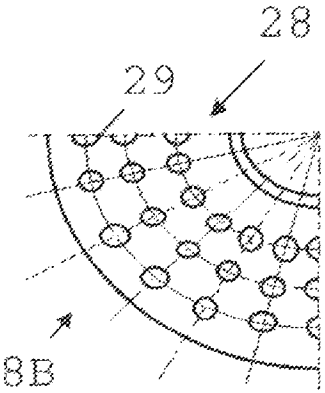

The fins may be formed with any other desired pattern. In FIG. 4, fin 19 is formed with a plurality of circumferentially and axially spaced dimples 21, e.g. having a diameter of 4-6 mm. In FIG. 5, fin 24 is formed with a plurality of circumferentially spaced circular apertures 27, e.g. circumferentially spaced by an angle of 30 degrees and having a diameter of one-third to one-fourth the radial dimension of the fin. In FIG. 6, fin 28 is formed with three rows of circumferentially spaced small-diameter apertures 29.

Figure 7A:
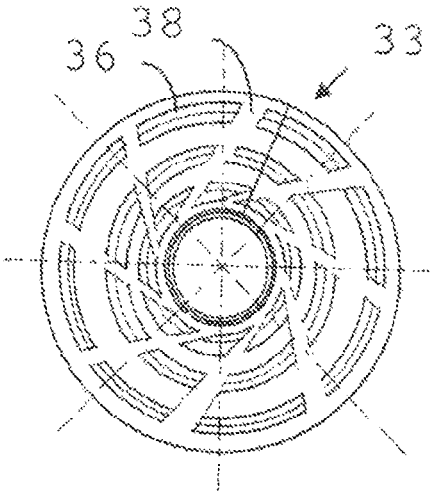
FIG. 7A is a front view of a finned heat exchanger tube according to another embodiment of the invention.
Figure 7B:
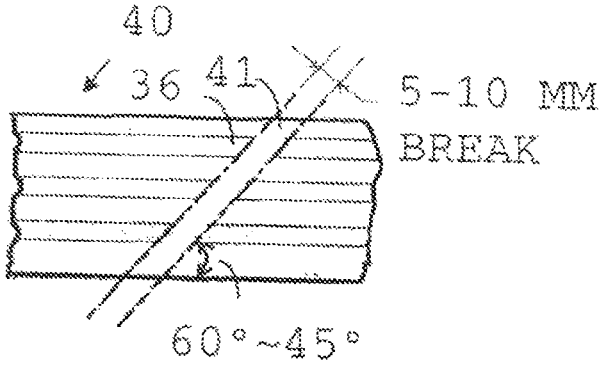
FIG. 7B is a front view of a preformed ribbon for use in producing the fin of FIG. 7A.
Figure 8A:
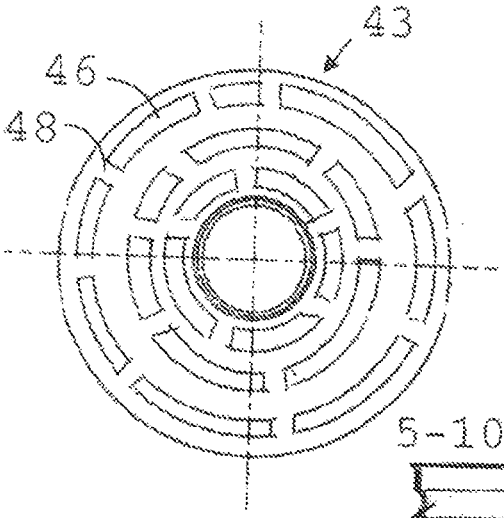
FIG. 8A is a front view of a finned heat exchanger tube according to another embodiment of the invention.
Figure 8B:
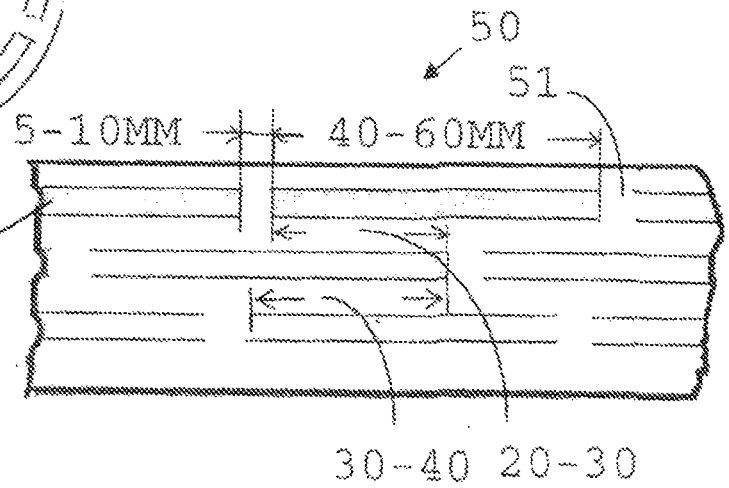
FIG. 8B is a front view of a preformed ribbon for use in producing the fin of FIG. 8A.

The depressions may also be formed with discontinuities. In FIGS. 7A-B, annular depressions 36 of fin 33 have aligned circumferential discontinuities 38 formed by preformed inclined slots 41 in an aluminum ribbon 40. In FIGS. 8A-B, annular depressions 46 of fin 43 have broken circumferential discontinuities 48 formed by preformed vertical slots 51 in an aluminum ribbon 50.

The use of a base in conjunction with the patterned fins of the present invention not only provides added heat transfer for the heat exchanger by virtue of the added heat transfer area connected to the tube surface, but also provides protection against possible corrosion. Vigorous air flow in and in the vicinity of the patterned fins can induces entrainment of rain droplets, or droplets of any other type of precipitation, onto the tube surface. The passage of precipitation derived moisture onto the tube surface is exacerbated by the presence of the preformed patterns, such as apertures 27 of FIG. 5 or discontinuities 38 of FIG. 7A, through which precipitation directly falls onto the tube surface, or by the presence of depressions 8 of FIG. 1 or dimples 21 of FIG. 4 in which rainwater can accumulate and then drain onto the tube surface. However by forming the fins with a base such that the tube surface is completely covered, precipitation is assured of not reaching the tube surface, thereby preventing potential corrosion. The tube may therefore be made of inexpensive material such as carbon steel by virtue of the corrosion preventing feature afforded by the base, rather than expensive corrosion resisting materials such as stainless steel.

The production of a patterned fin with an angled base needs particular care and design since the preformed patterns weaken the tensile strength of a machine fed ribbon of aluminum, or of any other material from which the fins are made, thus rendering a fin assembly operation more prone to failure. Despite the fragility of the preformed aluminum ribbon, the fins are advantageously able to be automatically connected to a tube.

FIGS. 9-12 illustrate apparatus for automatically fabricating a tube finned with a base. As the aluminum ribbon is fed, the base is formed and the tube is rotated, allowing the base to be securely connected to the tube surface.

Figure 9:
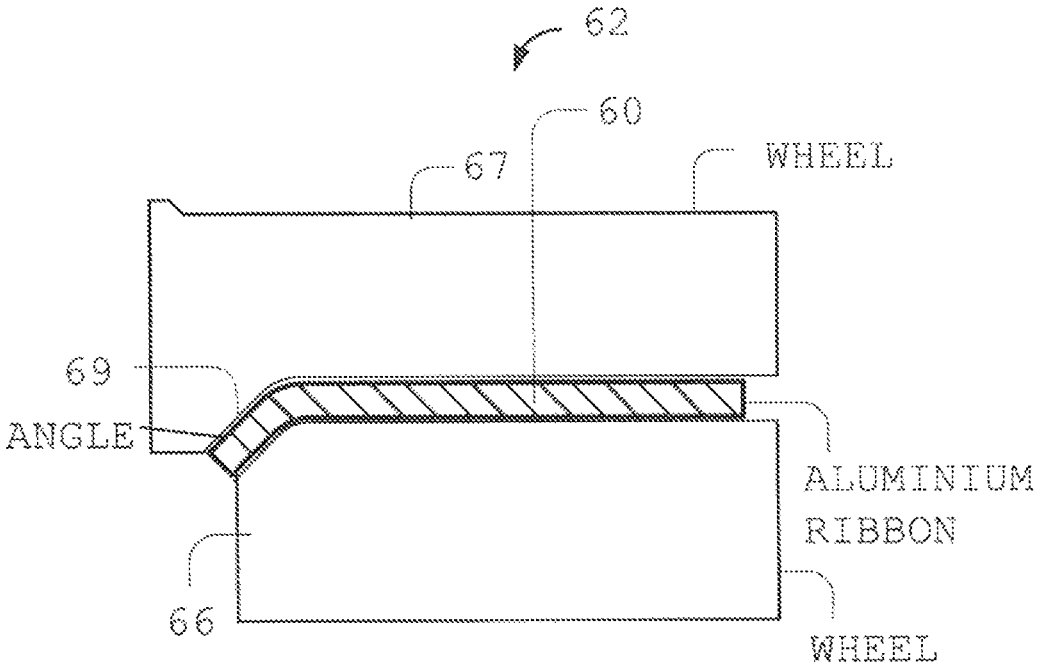
FIG. 9 is a cross-section view of a base forming station.
Figure 10:
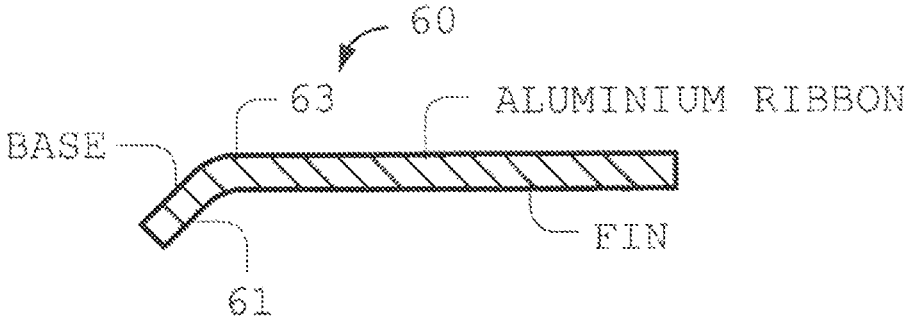
FIG. 10 is a cross-section view of a ribbon after exiting from the base forming station of FIG. 9.

With reference to FIG. 9, aluminum ribbon 60 is fed to base forming station 62 comprising lower roller 66 and upper roller 67 provided with an angled periphery 69, for example angled by 20 degrees with respect to the horizontal plane. While ribbon 60 is longitudinally fed when upper roller 67 is being rotated, angled periphery 69 applies a force onto the ribbon to form a base 61 which is angled with respect to elongated portion 63, as shown in FIG. 10.

Figure 11:
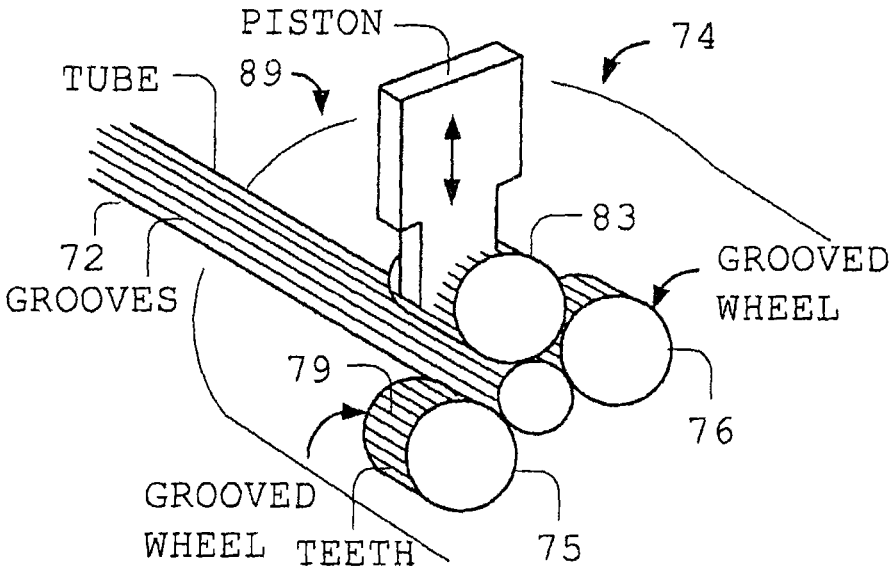
FIG. 11 is a front view of an indentation forming station.

During the formation of the base, a very long tube 72, e.g. having a length of 20 m, is fed while being spun through an indentation forming station 74 shown in FIG. 11 prior to connection with the fins. Station 74 comprises two lower rollers 75 and 76 between which tube 72 is fed. Both lower rollers are toothed wheels configured with teeth 79, or other types of protrusions, on a region of its outer face. Teeth 79 cause shallow axial indentations 86, e.g. of 0.1 mm depth, to be formed on the circumference of the tube surface.

Tube 72 is longitudinally advanced by means of upper roller 83, which is raised and lowered by a piston driven mechanism 89 as well as lower rollers 75 and 76. Upper roller 83 and lower rollers 75 and 76 may be oriented at an incline with respect to the tube surface, so that they will frictionally engage the tube surface and cause the tube to be longitudinally displaced.

Figure 12:
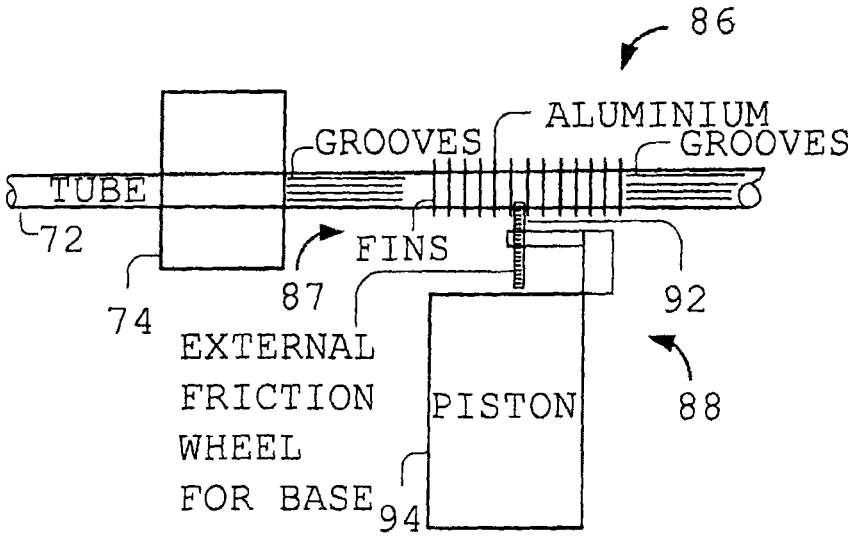
FIG. 12 is a side view of a fin connecting station.

FIG. 12 illustrates the fin connecting station 88. After tube 72 exits indentation forming station 74, it is fed to fin connecting station 87. While tube 72 continues to spin, the aluminum ribbon is fed to station 87 after exiting the base forming station. Fin connecting station 88 comprises a synchronized external friction wheel 92 driven by a piston mechanism 94 for applying force onto the base so that the latter will be secured into a corresponding indentation throughout the circumference of the tube.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. An air cooled, finned heat exchanger tube, comprising:

a metallic tube through which fluid to be cooled is flowable along a direction of a longitudinal axis of the metallic tube, wherein an outer surface of said tube comprises an array of indentations formed on the external circumference of the tube, each of said indentations being elongated, on the external circumference of the tube, in the direction of the longitudinal axis of the metallic tube and a plurality of axially spaced fins, each of which comprises a main element formed with enhanced heat transfer promoting patterns and a base angled with respect to said main element, wherein the bases of said fins are frictionally and irremovably secured within said indentations such that said tube outer surface is completely covered by the bases of said fins.

2. The heat exchanger tube according to claim 1, wherein the base of each fin extends to a proximal end of the main element of an axially adjacent fin.

3. The heat exchanger tube according to claim 1, wherein the fins are made of aluminum ribbon having a thickness ranging from 0.4 to 1.2 mm.

4. The heat exchanger tube according to claim 1, wherein the base of each one of the fins is stepped such that a portion of the base of an adjacent fin, in a direction opposite the angled direction of the base of the one of the fins with respect to said main element of the one of the fins, is positioned between the metallic tube and a portion of the base of the one of the fins.

* * * * *